US008061737B2

(12) United States Patent
Majot et al.

(10) Patent No.: US 8,061,737 B2
(45) Date of Patent: Nov. 22, 2011

(54) COUPLING GUARD SYSTEM

(75) Inventors: Kevin M. Majot, Little Genessee, NY (US); Charles A. Rohrs, Alleghany, NY (US)

(73) Assignee: Dresser-Rand Company, Olean, NY (US)

( * ) Notice: Subject to any disclaimer, the term of this patent is extended or adjusted under 35 U.S.C. 154(b) by 426 days.

(21) Appl. No.: 12/441,903

(22) PCT Filed: Sep. 25, 2007

(86) PCT No.: PCT/US2007/079352

§ 371 (c)(1),
(2), (4) Date: Apr. 15, 2009

(87) PCT Pub. No.: WO2008/039734

PCT Pub. Date: Apr. 3, 2008

(65) Prior Publication Data

US 2010/0044966 A1 Feb. 25, 2010

Related U.S. Application Data

(60) Provisional application No. 60/826,805, filed on Sep. 25, 2006.

(51) Int. Cl.
*F16L 11/12* (2006.01)

(52) U.S. Cl. ..... 285/45; 285/325; 464/172

(58) Field of Classification Search ..... 285/45, 285/48, 52, 145.1, 325, 330, 369, 417; 417/360, 417/361, 422, 423.14; 464/170, 172, 171
See application file for complete search history.

(56) References Cited

U.S. PATENT DOCUMENTS

| | | | | |
|---|---|---|---|---|
| 815,812 | A | 3/1906 | Gow | |
| 1,003,096 | A * | 9/1911 | Fawcett | 464/170 |
| 1,057,613 | A | 4/1913 | Baldwin | |
| 1,061,656 | A | 5/1913 | Black | |
| 1,480,775 | A | 1/1924 | Marien | |
| 1,622,768 | A | 3/1927 | Cook et al. | |
| 1,642,454 | A | 9/1927 | Malmstrom | |
| 2,006,244 | A | 6/1935 | Kopsa | |
| 2,116,290 | A * | 5/1938 | Spicer | 464/172 |
| 2,300,766 | A | 11/1942 | Baumann | |
| 2,328,031 | A | 8/1943 | Risley | |
| 2,345,437 | A | 3/1944 | Tinker | |

(Continued)

FOREIGN PATENT DOCUMENTS

CA 2647511 10/2007

(Continued)

OTHER PUBLICATIONS

International Search Report and the Written Opinion of the International Searching Authority for Patent Cooperation Treaty Application No. PCT/US2007/079352. date Aug. 27, 2008, pp. 1-8.

(Continued)

*Primary Examiner* — David E Bochna
(74) *Attorney, Agent, or Firm* — Edmonds & Nolte, PC

(57) ABSTRACT

A guard system for a coupling that connects a first component to a second component in a pressurized machinery system includes a coupling guard moveable between an open position, which allows access to an internal region of the coupling, and a closed position, which forms a seal surrounding the coupling from the first component to the second component. The system also includes a guide for directing movement of the coupling guard.

18 Claims, 6 Drawing Sheets

U.S. PATENT DOCUMENTS

| | | | | | |
|---|---|---|---|---|---|
| 2,602,462 | A | | 7/1952 | Barrett | |
| 2,811,303 | A | | 10/1957 | Ault et al. | |
| 2,836,117 | A | | 5/1958 | Lankford | |
| 2,868,565 | A | | 1/1959 | Suderow | |
| 2,897,917 | A | | 8/1959 | Hunter | |
| 2,932,360 | A | | 4/1960 | Hungate | |
| 2,954,841 | A | | 10/1960 | Reistle | |
| 3,044,657 | A | | 7/1962 | Horton | |
| 3,191,364 | A | | 6/1965 | Sylvan | |
| 3,198,214 | A | | 8/1965 | Lorenz | |
| 3,204,696 | A | | 9/1965 | De Priester et al. | |
| 3,213,794 | A | | 10/1965 | Adams | |
| 3,220,245 | A | | 11/1965 | Van Winkle | |
| 3,273,325 | A | | 9/1966 | Gerhold | |
| 3,352,577 | A | | 11/1967 | Medney | |
| 3,395,511 | A | | 8/1968 | Akerman | |
| 3,402,434 | A | | 9/1968 | Kajimura et al. | |
| 3,431,747 | A | | 3/1969 | Hasheimi et al. | |
| 3,454,163 | A | | 7/1969 | Read | |
| 3,487,432 | A | | 12/1969 | Jenson | |
| 3,490,209 | A | | 1/1970 | Fernandes et al. | |
| 3,500,614 | A | | 3/1970 | Soo | |
| 3,560,029 | A | * | 2/1971 | Floyd, Jr. | 285/369 |
| 3,578,342 | A | | 5/1971 | Satterthwaite et al. | |
| 3,628,812 | A | | 12/1971 | Larraide et al. | |
| 3,672,733 | A | | 6/1972 | Arsenius et al. | |
| 3,814,486 | A | | 6/1974 | Schurger | |
| 3,829,179 | A | | 8/1974 | Kurita et al. | |
| 3,915,673 | A | | 10/1975 | Tamai et al. | |
| 3,975,123 | A | | 8/1976 | Schibbye | |
| 4,033,647 | A | | 7/1977 | Beavers | |
| 4,059,364 | A | | 11/1977 | Anderson et al. | |
| 4,078,809 | A | | 3/1978 | Garrick et al. | |
| 4,087,261 | A | | 5/1978 | Hays | |
| 4,103,899 | A | | 8/1978 | Turner | |
| 4,112,687 | A | | 9/1978 | Dixon | |
| 4,117,359 | A | | 9/1978 | Wehde | |
| 4,135,542 | A | | 1/1979 | Chisholm | |
| 4,141,283 | A | | 2/1979 | Swanson et al. | |
| 4,146,261 | A | | 3/1979 | Edmaier et al. | |
| 4,165,622 | A | | 8/1979 | Brown, Jr. | |
| 4,174,925 | A | | 11/1979 | Pfenning et al. | |
| 4,182,480 | A | | 1/1980 | Theyse et al. | |
| 4,197,990 | A | | 4/1980 | Carberg et al. | |
| 4,205,927 | A | | 6/1980 | Simmons | |
| 4,227,373 | A | | 10/1980 | Amend et al. | |
| 4,258,551 | A | | 3/1981 | Ritzi | |
| 4,259,045 | A | | 3/1981 | Teruyama | |
| 4,278,200 | A | | 7/1981 | Gunnewig | |
| 4,298,311 | A | | 11/1981 | Ritzi | |
| 4,324,533 | A | * | 4/1982 | Schroeder et al. | 417/360 |
| 4,333,748 | A | | 6/1982 | Erickson | |
| 4,334,592 | A | | 6/1982 | Fair | |
| 4,336,693 | A | | 6/1982 | Hays et al. | |
| 4,339,923 | A | | 7/1982 | Hays et al. | |
| 4,347,900 | A | | 9/1982 | Barrington | |
| 4,363,608 | A | | 12/1982 | Mulders | |
| 4,374,583 | A | | 2/1983 | Barrington | |
| 4,375,975 | A | | 3/1983 | McNicholas | |
| 4,382,804 | A | | 5/1983 | Mellor | |
| 4,384,724 | A | | 5/1983 | Derman et al. | |
| 4,391,102 | A | | 7/1983 | Studhalter et al. | |
| 4,396,361 | A | | 8/1983 | Fraser | |
| 4,432,470 | A | | 2/1984 | Sopha | |
| 4,438,638 | A | | 3/1984 | Hays et al. | |
| 4,441,322 | A | | 4/1984 | Ritzi | |
| 4,442,925 | A | | 4/1984 | Fukushima et al. | |
| 4,453,893 | A | | 6/1984 | Hutmaker | |
| 4,463,567 | A | | 8/1984 | Amend et al. | |
| 4,468,234 | A | | 8/1984 | McNicholas | |
| 4,471,795 | A | | 9/1984 | Linhardt | |
| 4,477,223 | A | | 10/1984 | Giroux | |
| 4,502,839 | A | | 3/1985 | Maddox et al. | |
| 4,511,309 | A | | 4/1985 | Maddox | |
| 4,531,888 | A | | 7/1985 | Buchelt | |
| 4,536,134 | A | | 8/1985 | Huiber | |
| 4,541,531 | A | | 9/1985 | Brule | |
| 4,541,607 | A | | 9/1985 | Hotger | |
| 4,573,527 | A | | 3/1986 | McDonough | |
| 4,574,815 | A | | 3/1986 | West et al. | |
| 4,648,806 | A | | 3/1987 | Alexander | |
| 4,687,017 | A | | 8/1987 | Danko et al. | |
| 4,737,081 | A | | 4/1988 | Nakajima et al. | |
| 4,752,185 | A | | 6/1988 | Butler et al. | |
| 4,807,664 | A | | 2/1989 | Wilson et al. | |
| 4,813,495 | A | | 3/1989 | Leach | |
| 4,821,737 | A | | 4/1989 | Nelson | |
| 4,826,403 | A | | 5/1989 | Catlow | |
| 4,830,331 | A | | 5/1989 | Vindum | |
| 4,832,709 | A | | 5/1989 | Nagyszalanczy | |
| 4,848,409 | A | * | 7/1989 | Jahnke, Jr. | 464/170 |
| 4,904,284 | A | | 2/1990 | Hanabusa | |
| 4,984,830 | A | | 1/1991 | Saunders | |
| 5,007,328 | A | | 4/1991 | Otterman | |
| 5,024,585 | A | | 6/1991 | Kralovec | |
| 5,043,617 | A | | 8/1991 | Rostron | |
| 5,044,701 | A | | 9/1991 | Watanabe et al. | |
| 5,045,046 | A | | 9/1991 | Bond | |
| 5,054,995 | A | | 10/1991 | Kaseley et al. | |
| 5,064,452 | A | | 11/1991 | Yano et al. | |
| 5,080,137 | A | | 1/1992 | Adams | |
| 5,190,440 | A | | 3/1993 | Maier et al. | |
| 5,202,024 | A | | 4/1993 | Andersson et al. | |
| 5,202,026 | A | | 4/1993 | Lema | |
| 5,203,891 | A | | 4/1993 | Lema | |
| 5,207,810 | A | | 5/1993 | Sheth | |
| 5,211,427 | A | | 5/1993 | Washizu | |
| 5,246,346 | A | | 9/1993 | Schiesser | |
| 5,285,123 | A | | 2/1994 | Kataoka et al. | |
| 5,306,051 | A | | 4/1994 | Loker et al. | |
| 5,337,779 | A | | 8/1994 | Fukuhara | |
| 5,378,121 | A | | 1/1995 | Hackett | |
| 5,385,446 | A | | 1/1995 | Hays | |
| 5,421,708 | A | | 6/1995 | Utter | |
| 5,443,581 | A | | 8/1995 | Malone | |
| 5,484,521 | A | | 1/1996 | Kramer | |
| 5,496,394 | A | | 3/1996 | Nied | |
| 5,500,039 | A | | 3/1996 | Mori et al. | |
| 5,509,858 | A | * | 4/1996 | Grosse-Entrup | 464/172 |
| 5,525,034 | A | | 6/1996 | Hays | |
| 5,525,146 | A | | 6/1996 | Straub | |
| 5,531,811 | A | | 7/1996 | Kloberdanz | |
| 5,538,259 | A | | 7/1996 | Uhrner et al. | |
| 5,542,831 | A | | 8/1996 | Scarfone | |
| 5,575,309 | A | | 11/1996 | Connell | |
| 5,585,000 | A | | 12/1996 | Sassi | |
| 5,605,172 | A | | 2/1997 | Schubert et al. | |
| 5,628,623 | A | | 5/1997 | Skaggs | |
| 5,634,492 | A | | 6/1997 | Steinruck et al. | |
| 5,640,472 | A | | 6/1997 | Meinzer et al. | |
| 5,641,280 | A | | 6/1997 | Timuska | |
| 5,653,347 | A | | 8/1997 | Larsson | |
| 5,664,420 | A | | 9/1997 | Hays | |
| 5,682,759 | A | | 11/1997 | Hays | |
| 5,683,235 | A | | 11/1997 | Welch | |
| 5,685,691 | A | | 11/1997 | Hays | |
| 5,687,249 | A | | 11/1997 | Kato | |
| 5,693,125 | A | | 12/1997 | Dean | |
| 5,703,424 | A | | 12/1997 | Dorman | |
| 5,709,528 | A | | 1/1998 | Hablanian | |
| 5,713,720 | A | | 2/1998 | Barhoum | |
| 5,720,799 | A | | 2/1998 | Hays | |
| 5,750,040 | A | | 5/1998 | Hays | |
| 5,775,882 | A | | 7/1998 | Kiyokawa et al. | |
| 5,779,619 | A | | 7/1998 | Borgstrom et al. | |
| 5,795,135 | A | | 8/1998 | Nyilas et al. | |
| 5,800,092 | A | | 9/1998 | Nill et al. | |
| 5,848,616 | A | | 12/1998 | Vogel et al. | |
| 5,850,857 | A | | 12/1998 | Simpson | |
| 5,853,585 | A | | 12/1998 | Nesseth | |
| 5,863,023 | A | | 1/1999 | Evans et al. | |
| 5,899,435 | A | | 5/1999 | Mitsch et al. | |
| 5,935,053 | A | | 8/1999 | Strid | |
| 5,938,803 | A | | 8/1999 | Dries | |
| 5,938,819 | A | | 8/1999 | Seery | |
| 5,946,915 | A | | 9/1999 | Hays | |
| 5,951,066 | A | | 9/1999 | Lane et al. | |

5,965,022 A 10/1999 Gould
5,967,746 A 10/1999 Hagi et al.
5,971,702 A 10/1999 Afton et al.
5,971,907 A 10/1999 Johannemann et al.
5,980,218 A 11/1999 Takahashi et al.
5,988,524 A 11/1999 Odajima et al.
6,035,934 A 3/2000 Stevenson et al.
6,059,539 A 5/2000 Nyilas et al.
6,068,447 A 5/2000 Foege
6,090,174 A 7/2000 Douma et al.
6,090,299 A 7/2000 Hays et al.
6,113,675 A 9/2000 Branstetter
6,122,915 A 9/2000 Hays
6,123,363 A 9/2000 Burgard et al.
6,145,844 A 11/2000 Waggott
6,149,825 A 11/2000 Gargas
6,151,881 A 11/2000 Ai et al.
6,190,261 B1 * 2/2001 Powell ..... 464/170
6,196,962 B1 3/2001 Purvey et al.
6,206,202 B1 3/2001 Galk et al.
6,214,075 B1 4/2001 Filges et al.
6,217,637 B1 4/2001 Toney et al.
6,227,379 B1 5/2001 Nesseth
6,277,278 B1 8/2001 Conrad et al.
6,312,021 B1 11/2001 Thomas
6,314,738 B1 11/2001 Hays
6,372,006 B1 4/2002 Pregenzer et al.
6,375,437 B1 4/2002 Nolan
6,383,262 B1 5/2002 Marthinsen et al.
6,394,764 B1 5/2002 Samurin
6,398,973 B1 6/2002 Saunders et al.
6,402,465 B1 6/2002 Maier
6,426,010 B1 7/2002 Lecoffre et al.
6,464,469 B1 10/2002 Grob et al.
6,467,988 B1 10/2002 Czachor et al.
6,468,426 B1 10/2002 Klass
6,485,536 B1 11/2002 Masters
6,530,484 B1 3/2003 Bosman
6,530,979 B2 3/2003 Firey
6,531,066 B1 3/2003 Saunders et al.
6,537,035 B2 3/2003 Shumway
6,540,917 B1 4/2003 Rachels et al.
6,547,037 B2 4/2003 Kuzdzal
6,592,654 B2 7/2003 Brown
6,596,046 B2 7/2003 Conrad et al.
6,599,086 B2 7/2003 Soja
6,607,348 B2 8/2003 Jean
6,616,719 B1 9/2003 Sun et al.
6,617,731 B1 9/2003 Goodnick
6,629,825 B2 10/2003 Stickland et al.
6,631,617 B1 10/2003 Dreiman et al.
6,658,986 B2 12/2003 Pitla et al.
6,659,143 B1 12/2003 Taylor et al.
6,669,845 B2 12/2003 Klass
6,688,802 B2 2/2004 Ross et al.
6,707,200 B2 3/2004 Carroll et al.
6,718,955 B1 4/2004 Knight
6,719,830 B2 4/2004 Illingworth et al.
6,764,284 B2 7/2004 Oehman, Jr.
6,776,812 B2 8/2004 Komura et al.
6,802,693 B2 10/2004 Reinfeld et al.
6,802,881 B2 10/2004 Illingworth et al.
6,811,713 B2 11/2004 Arnaud
6,817,846 B2 11/2004 Bennitt
6,837,913 B2 1/2005 Schilling et al.
6,843,836 B2 1/2005 Kitchener
6,878,187 B1 4/2005 Hays et al.
6,893,208 B2 5/2005 Frosini et al.
6,907,933 B2 6/2005 Choi et al.
6,979,358 B2 12/2005 Ekker
7,001,448 B1 2/2006 West
7,013,978 B2 3/2006 Appleford et al.
7,022,150 B2 4/2006 Borgstrom et al.
7,022,153 B2 4/2006 McKenzie
7,025,890 B2 4/2006 Moya
7,033,410 B2 4/2006 Hilpert et al.
7,033,411 B2 4/2006 Carlsson et al.
7,056,363 B2 6/2006 Carlsson et al.
7,063,465 B1 6/2006 Wilkes et al.
7,112,036 B2 9/2006 Lubell et al.
7,131,292 B2 11/2006 Ikegami et al.
7,144,226 B2 12/2006 Pugnet et al.
7,159,723 B2 1/2007 Hilpert et al.
7,160,518 B2 1/2007 Chen et al.
7,169,305 B2 1/2007 Gomez
7,185,447 B2 3/2007 Arbeiter
7,204,241 B2 4/2007 Thompson
7,238,113 B2 * 7/2007 Lukac ..... 464/172
7,241,392 B2 7/2007 Maier
7,244,111 B2 7/2007 Suter et al.
7,258,713 B2 8/2007 Eubank et al.
7,270,145 B2 9/2007 Koezler
7,288,202 B2 10/2007 Maier
7,314,560 B2 1/2008 Yoshida et al.
7,323,023 B2 1/2008 Michele et al.
7,328,749 B2 2/2008 Reitz
7,335,313 B2 2/2008 Moya
7,377,110 B2 5/2008 Sheridan et al.
7,381,235 B2 6/2008 Koene et al.
7,396,373 B2 7/2008 Lagerstedt et al.
7,399,412 B2 7/2008 Keuschnigg
7,435,290 B2 10/2008 Lane et al.
7,445,653 B2 11/2008 Trautmann et al.
7,470,299 B2 12/2008 Han et al.
7,473,083 B2 1/2009 Oh et al.
7,479,171 B2 1/2009 Cho et al.
7,494,523 B2 2/2009 Oh et al.
7,501,002 B2 3/2009 Han et al.
7,520,210 B2 4/2009 Theodore, Jr. et al.
7,520,816 B1 * 4/2009 Brisk ..... 464/172
7,575,422 B2 8/2009 Bode et al.
7,578,863 B2 8/2009 Becker et al.
7,591,882 B2 9/2009 Harazim
7,594,941 B2 9/2009 Zheng et al.
7,594,942 B2 9/2009 Polderman
7,610,955 B2 11/2009 Irwin, Jr.
7,628,836 B2 12/2009 Baronet et al.
7,637,699 B2 12/2009 Albrecht
7,674,377 B2 3/2010 Carew
7,677,308 B2 3/2010 Kolle
7,708,537 B2 5/2010 Bhatia et al.
7,708,808 B1 5/2010 Heumann
7,744,663 B2 6/2010 Wallace
7,748,079 B2 7/2010 McDowell et al.
7,766,989 B2 8/2010 Lane et al.
7,811,344 B1 10/2010 Duke et al.
7,811,347 B2 10/2010 Carlsson et al.
7,815,415 B2 10/2010 Kanezawa et al.
7,824,458 B2 11/2010 Borgstrom et al.
7,824,459 B2 11/2010 Borgstrom et al.
7,846,228 B1 12/2010 Saaski et al.
2001/0007283 A1 7/2001 Johal et al.
2002/0009361 A1 1/2002 Reichert et al.
2003/0029318 A1 2/2003 Firey
2003/0035718 A1 2/2003 Langston et al.
2003/0136094 A1 7/2003 Illingworth et al.
2004/0007261 A1 1/2004 Cornwell
2004/0170505 A1 9/2004 Lenderink et al.
2005/0173337 A1 8/2005 Costinel
2006/0065609 A1 3/2006 Arthur
2006/0090430 A1 5/2006 Trautman et al.
2006/0096933 A1 5/2006 Maier
2006/0157251 A1 7/2006 Stinessen et al.
2006/0157406 A1 7/2006 Maier
2006/0193728 A1 8/2006 Lindsey et al.
2006/0222515 A1 10/2006 Delmotte et al.
2006/0230933 A1 10/2006 Harazim
2006/0239831 A1 10/2006 Garris, Jr.
2006/0254659 A1 11/2006 Ballot et al.
2006/0275160 A1 12/2006 Leu et al.
2007/0029091 A1 2/2007 Stinessen et al.
2007/0036646 A1 2/2007 Nguyen et al.
2007/0051245 A1 3/2007 Yun
2007/0062374 A1 3/2007 Kolle
2007/0065317 A1 3/2007 Stock
2007/0084340 A1 4/2007 Dou et al.
2007/0140870 A1 6/2007 Fukanuma et al.
2007/0151922 A1 7/2007 Mian

| | | | |
|---|---|---|---|
| 2007/0163215 | A1 | 7/2007 | Lagerstadt |
| 2007/0172363 | A1 | 7/2007 | Laboube et al. |
| 2007/0196215 | A1 | 8/2007 | Frosini et al. |
| 2007/0227969 | A1 | 10/2007 | Dehaene et al. |
| 2007/0294986 | A1 | 12/2007 | Beetz |
| 2008/0031732 | A1 | 2/2008 | Peer et al. |
| 2008/0039732 | A9 | 2/2008 | Bowman |
| 2008/0246281 | A1 | 10/2008 | Agrawal et al. |
| 2008/0315812 | A1 | 12/2008 | Balboul |
| 2009/0013658 | A1 | 1/2009 | Borgstrom et al. |
| 2009/0015012 | A1 | 1/2009 | Metzler et al. |
| 2009/0025562 | A1 | 1/2009 | Hallgren et al. |
| 2009/0025563 | A1 | 1/2009 | Borgstrom et al. |
| 2009/0151928 | A1 | 6/2009 | Lawson |
| 2009/0159523 | A1 | 6/2009 | McCutchen |
| 2009/0169407 | A1 | 7/2009 | Yun |
| 2009/0173095 | A1 | 7/2009 | Bhatia et al. |
| 2009/0266231 | A1 | 10/2009 | Franzen et al. |
| 2009/0304496 | A1 | 12/2009 | Maier |
| 2009/0321343 | A1 | 12/2009 | Maier |
| 2009/0324391 | A1 | 12/2009 | Maier |
| 2010/0007133 | A1 | 1/2010 | Maier |
| 2010/0021292 | A1 | 1/2010 | Maier et al. |
| 2010/0038309 | A1 | 2/2010 | Maier |
| 2010/0043288 | A1 | 2/2010 | Wallace |
| 2010/0043364 | A1 | 2/2010 | Curien |
| 2010/0044966 | A1 | 2/2010 | Majot et al. |
| 2010/0072121 | A1 | 3/2010 | Maier |
| 2010/0074768 | A1 | 3/2010 | Maier |
| 2010/0083690 | A1 | 4/2010 | Sato et al. |
| 2010/0090087 | A1 | 4/2010 | Maier |
| 2010/0143172 | A1 | 6/2010 | Sato et al. |
| 2010/0163232 | A1 | 7/2010 | Koll |
| 2010/0183438 | A1 | 7/2010 | Maier et al. |
| 2010/0239419 | A1 | 9/2010 | Maier et al. |
| 2010/0239437 | A1 | 9/2010 | Maier |
| 2010/0247299 | A1 | 9/2010 | Maier |
| 2010/0257827 | A1 | 10/2010 | Lane et al. |
| 2011/0017307 | A1 | 1/2011 | Kidd et al. |
| 2011/0061536 | A1 | 3/2011 | Maier et al. |

FOREIGN PATENT DOCUMENTS

| | | |
|---|---|---|
| EP | 301285 | 10/1991 |
| EP | 1582703 | 10/2005 |
| EP | 2013479 | 1/2009 |
| EP | 7838631.5 | 12/2009 |
| GB | 2323639 | 9/1998 |
| GB | 2337561 | 11/1999 |
| JP | 54099206 | 1/1978 |
| JP | 08 068501 | 3/1996 |
| JP | 8-284961 A | 11/1996 |
| JP | 2002 242699 | 8/2002 |
| JP | 2004034017 A | 2/2004 |
| JP | 3711028 | 10/2005 |
| JP | 2005291202 | 10/2005 |
| KR | 2009085521 | 2/2008 |
| MX | 2008012579 | 12/2008 |
| WO | 9524563 | 9/1995 |
| WO | 0117096 | 3/2001 |
| WO | 2007043889 | 4/2007 |
| WO | 2007103248 | 9/2007 |
| WO | 2007120506 | 10/2007 |
| WO | 2008036221 | 3/2008 |
| WO | 2008039446 | 3/2008 |
| WO | 2008039491 | 4/2008 |
| WO | 2008039731 | 4/2008 |
| WO | 2008039732 | 4/2008 |
| WO | 2008039733 | 4/2008 |
| WO | 2008039734 | 4/2008 |
| WO | 2008036394 | 7/2008 |
| WO | 2009111616 | 9/2009 |
| WO | 2009158252 | 12/2009 |
| WO | 2009158253 | 12/2009 |
| WO | 2010083416 | 7/2010 |
| WO | 2010083427 | 7/2010 |
| WO | 2010107579 | 9/2010 |
| WO | 2010110992 | 9/2010 |
| WO | 2011034764 | 3/2011 |

OTHER PUBLICATIONS

PCT/US2007/008149 International Preliminary Report on Patentability dated Sep. 30, 2008.

PCT/US2007/008149 International Search Report and Written Opinion dated Jul. 17, 2008.

PCT/US2007/020101 International Preliminary Report on Patentability dated Apr. 2, 2009.

PCT/US2007/020101 International Search Report dated Apr. 29, 2008.

PCT/US2007/020101 Written Opinion dated Mar. 19, 2009.

PCT/US2007/020471 International Preliminary Report on Patentability dated Apr. 2, 2009.

PCT/US2007/020471 International Search Report and Written Opinion dated Apr. 1, 2008.

PCT/US2007/020659 International Preliminary Report on Patentability dated Mar. 31, 2009.

PCT/US2007/020659 International Search Report and Written Opinion dated Sep. 17, 2008.

PCT/US2007/020768 International Preliminary Report on Patentability dated Mar. 31, 2009.

PCT/US2007/020768 International Search Report and Written Opinion dated Mar. 3, 2008.

PCT/US2007/079348 International Preliminary Report on Patentability dated Mar. 31, 2009.

PCT/US2007/079348 International Search Report dated Apr. 11, 2008.

PCT/US2007/079348 Written Opinion dated Jan. 25, 2008.

PCT/US2007/079349 International Preliminary Report on Patentability dated Mar. 31, 2009.

PCT/US2007/079349 International Search Report and Written Opinion dated Apr. 2, 2008.

PCT/US2007/079350 International Preliminary Report on Patentability dated Mar. 31, 2009.

PCT/US2007/079350 International Search Report dated Jul. 17, 2008.

PCT/US2007/079350 Written Opinion dated Mar. 25, 2009.

PCT/US2007/079352 International Preliminary Report on Patentability dated Mar. 31, 2009.

PCT/US2007/079352 International Search Report and Written Opinion dated Aug. 27, 2008.

PCT/US2009/036142 International Preliminary Report on Patentability dated Sep. 16, 2010.

PCT/US2009/036142 International Search Report dated Jan. 7, 2010.

PCT/US2009/036142 Written Opinion dated May 11, 2009.

PCT/US2009/047662 International Preliminary Report on Patentability dated Jan. 13, 2011.

PCT/US2009/047662 Written Opinion dated Aug. 20, 2009.

PCT/US2010/021199 International Search Report and Written Opinion dated Mar. 22, 2010.

PCT/US2010/021199 International Preliminary Report on Patentability dated Mar. 29, 2011.

PCT/US2010/021218 International Search Report and Written Opinion dated Mar. 23, 2010.

PCT/US2010/021218 International Report on Patentability dated Feb. 2, 2011.

PCT/US2010/025650 International Search Report and Written Opinion dated Apr. 22, 2010.

PCT/US2010/025650 International Report on Patentability dated Mar. 14, 2011.

PCT/US2010/025952 International Search Report and Written Opinion dated Apr. 12, 2010.

PCT/US2010/025952 International Report on Patentability dated Mar. 14, 2011.

PCT/US2009/047667 International Report on Patentability dated Jan. 13, 2011.

PCT/US2009/047667 Written Opinion dated Aug. 7, 2009.
PCT/US2009/047667 International Search Report dated Dec. 30, 2009.
Dresser-Rand, Inc. "High Pressure Air Compressor Model 13NL45," Oct. 28, 1991, 14 pages.
Technical Manual—High Pressure Air Compressor Model 13NL45; Navsea S6220-AT-MMA-010/93236, pp. 3-23 to 3-32, Electric Boat Corporation, Groton, CT 06340, Oct. 28, 1991.

* cited by examiner

COUPLING GUARD SYSTEM

CROSS-REFERENCE TO RELATED APPLICATION

Cross Reference

This application is a United States national phase application of co-pending international patent application number PCT/US2007/079352, filed Sep. 25, 2007, which claims priority to U.S. Provisional Patent Application No. 60/826,805, filed Sep. 25, 2006, the disclosures of which are incorporated herein by reference.

BACKGROUND

The present invention relates to connection members for components of pressure containing machinery and, more particularly, a coupling guard system for protecting and sealing an interior region of a coupling between components of the pressure containing machinery.

In existing close-coupled pressure containing machinery, the pressure containing device and structural support are combined into one unit. Historically, access to a coupling and its components has been limited due to generally small access ports in an outer casing of the coupling, which are provided for maintenance access. Combining the pressure sealing and structural support components leads to difficulty creating and maintaining a sealing surface between the co-joined equipment when sealing to contain low mole weight gasses.

SUMMARY

In one embodiment, the invention provides a guard system for a coupling that connects a first component to a second component in a pressurized machinery system. The guard system includes a coupling guard moveable between an open position, which allows access to an internal region of the coupling, and a closed position, which forms a seal surrounding the coupling from the first component to the second component. The guard system also includes a guide for directing movement of the coupling guard.

In another embodiment, the invention provides a guard system including a coupling guard moveable between an open position, which allows access to an internal region of the coupling, and a closed position, which forms a seal surrounding the coupling from the first component to the second component. A guide for directing movement of the coupling guard extends between the first component and the second component wherein the coupling guard is moveably coupled to the guide. An adjuster is coupled to the coupling guard for adjusting a position of the coupling guard relative to the guide.

In yet another embodiment, the invention provides a pressure containing coupling guard system for connecting a compressor casing to a drive casing in an industrial compression system. The coupling guard system includes a coupling guard moveable between an open position, which allows access to an internal region between the casings, and a closed position, which forms a seal surrounding the internal region. The coupling guard includes sealing surfaces comprising at least one radial sealing surface at one axial end of the coupling guard and at least one circumferential sealing surface at one axial end of the coupling. The system also includes a guide for directing axial movement of the coupling guard, wherein the guide has a slide bar extending between the compressor casing and the drive casing for aligning the coupling guard to at least one of the casings, and an adjuster for adjusting positioning of the coupling guard on the slide bar.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

For example, terms like "central", "upper", "lower", "front", "rear", and the like are only used to simplify the description of the present invention and do not alone indicate or imply that the device or element referred to must have a particular orientation. The elements of the retractable pressure containing coupling guard system referred to in the present invention can be installed and operated in any orientation desired. In addition, terms such as, "first", "second", and "third" are used herein for the purpose of description and are not intended to indicate or imply relative importance or significance.

DETAILED DESCRIPTION

Figure 1:
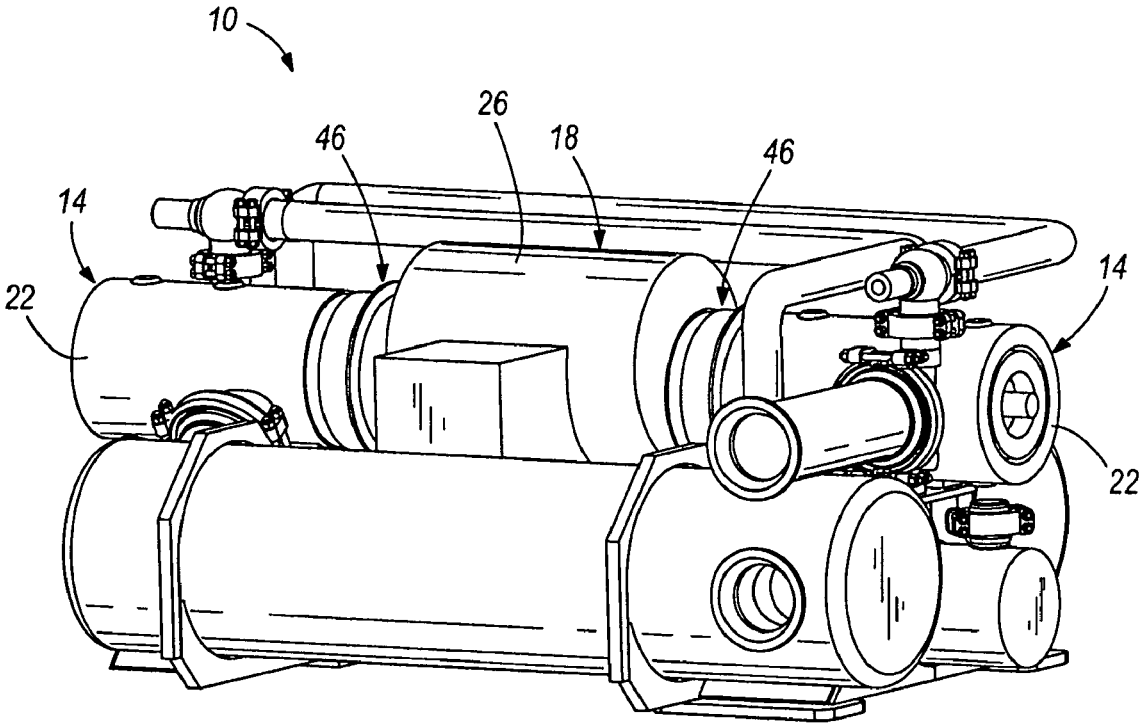
FIG. 1 is a perspective view of a close-coupled pressure containing machinery.

FIG. 1 illustrates a close-coupled pressure containing machinery system of a type that is suitable for use with the present invention. In FIG. 1 there is specifically shown an industrial compression system 10, which is used in industry to compress gasses or fluids for industrial purposes. The system 10 might, for example, be used on an oil drilling platform or an oil production platform. The industrial compression system 10 includes two compressors 14 close-coupled to a double-ended electric motor drive 18. This arrangement allows for a compact design with significant benefits over more traditional base-plate mounted compressor trains. Each compressor 14 is surrounded by a cylindrical compressor casing 22 and the motor 18 is surrounded by a cylindrical motor casing 26. The compressor casing 22 and the motor casing 26 are separate bodies that are positioned to facilitate installation and removal of components. The compressor casing 22 and the motor casing 26 are connected together with a coupling 30 (FIG. 3), which separates pressure containing components and provides a mechanical support structure for connecting the casings 22, 26.

Figure 3:
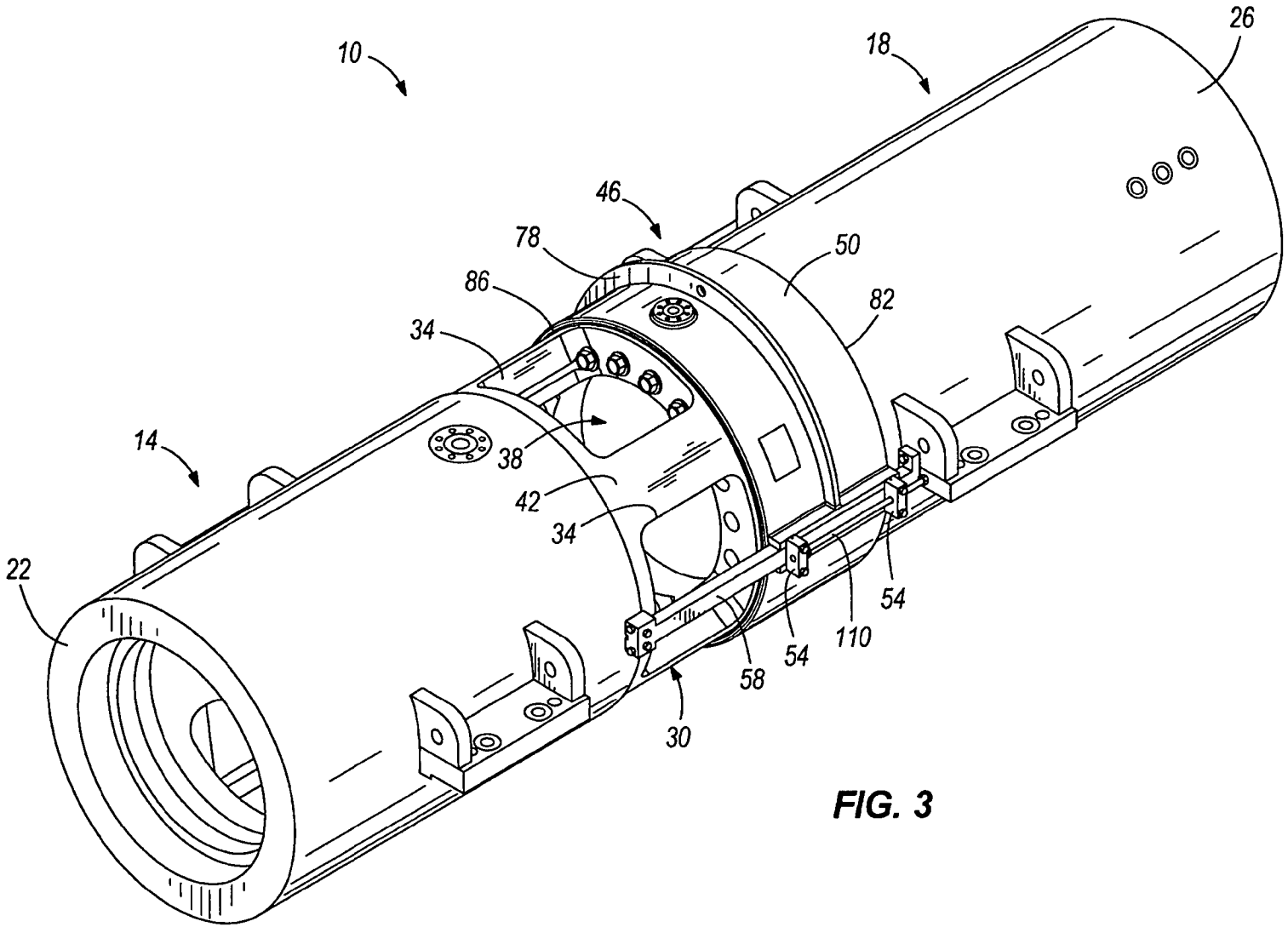
FIG. 3 is a perspective view of the machinery shown in FIG. 1, including the coupling guard system shown in FIG. 2 in an open position.

Referring to FIG. 3, the coupling 30 includes access ports 34. The ports 34 provide openings to facilitate removal of bearings, seals, gears, electrical connections and other components within an interior region 38 of the coupling 30 while the electrical drive 18 and the compressor 14 remain connected together. The coupling 30 is attached to the compressor casing 22 and the motor casing 26 with an attachment structure that resists various forces thereon. In the illustrated embodiment, a main case attachment structure 42, or casing, includes threaded studs and nuts for coupling 30 the coupling to the motor casing 26, and the like may be used for coupling the coupling 30 to the compressor casing 22. Other means of mechanical attachment may be employed such as shear rings or other commonly used attachment structures. The attachment structure 42 should be sufficiently sound structurally to prevent separation, vibration, disattachment, torquing or other problems in the integrity of the attachment of the compressor casing 22 to the motor casing 26.

In the illustrated embodiment, a coupling guard system 46 covers the coupling 30 to allow increased maintenance access to the coupling 30 and the associated components while maintaining a high degree of sealed joint integrity. The coupling guard system 46 is a retractable, pressure containing guard system. The coupling guard system 46 separates pressure containing components of the machinery system 10 from structural support components, and maintains a pressure seal over the access ports 34 in the coupling 30. It is desirable that the pressure containing structure 46 is independent of the main structural mechanical connection 30; therefore, a pressure containing sealing surface is not subject to mechanical loads associated with support and operation of the equipment. As an independent structure, the pressure containing sealing surface provides ease of maintenance and sealing integrity.

Figure 2:
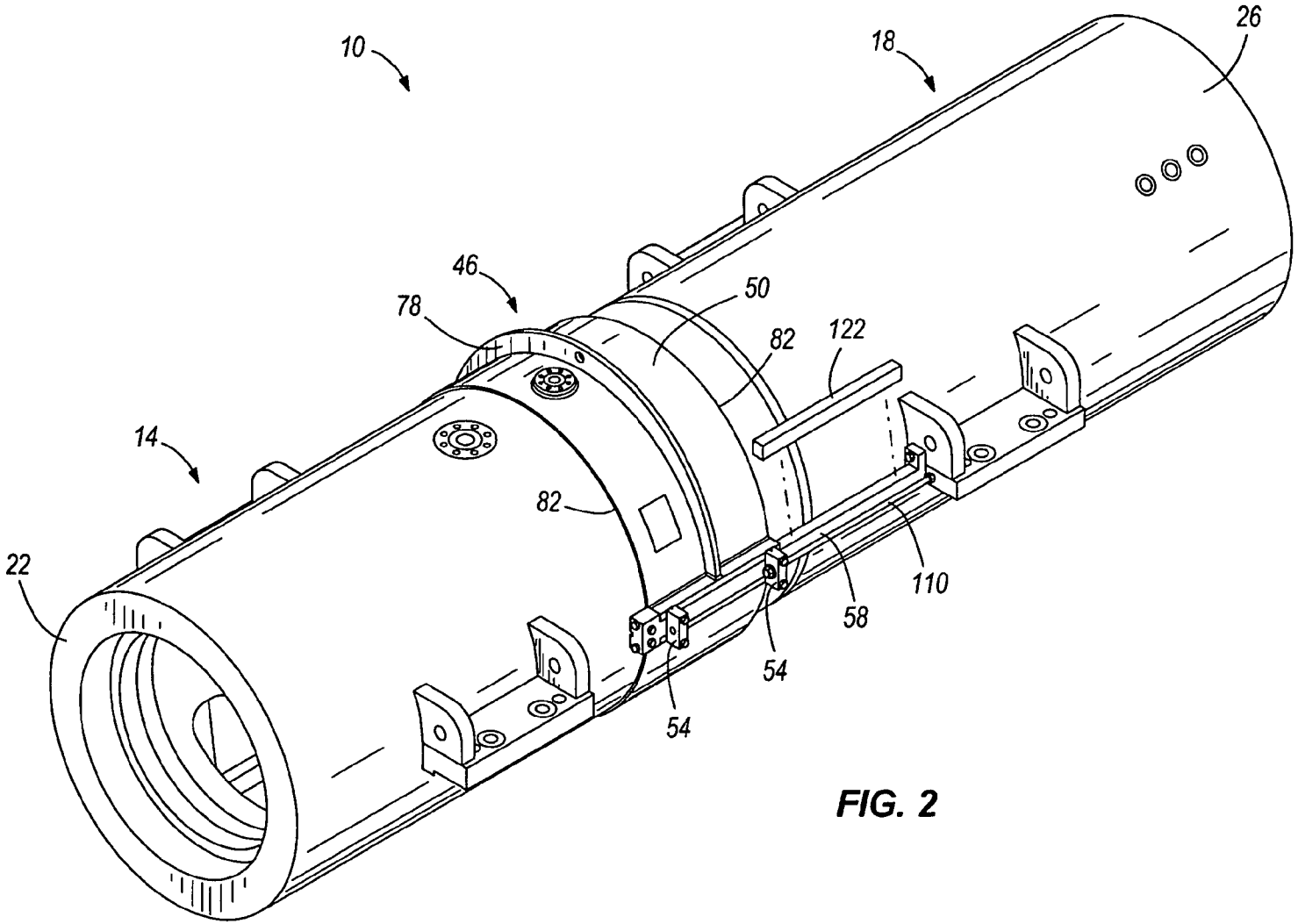
FIG. 2 is a perspective view of the machinery shown in FIG. 1, including a coupling guard system according to one embodiment of the invention and in a closed position.

FIG. 2 illustrates the coupling guard system 46 in a closed position to protect the coupling 30, and FIG. 3 illustrates the coupling guard system 46 in an open position to allow access to the coupling 30. In the open position, access to the interior region 38 of the coupling 30 is gained through the ports 34. In the closed position, the ports 34 are covered by a coupling guard 50, or cover, in order to seal the coupling 30 and components contained within the coupling 30. The coupling guard 50 is mounted to the machinery system 10 for axial movement, and may be locked into position to form a sealing surface over the coupling 30.

Figure 4A:
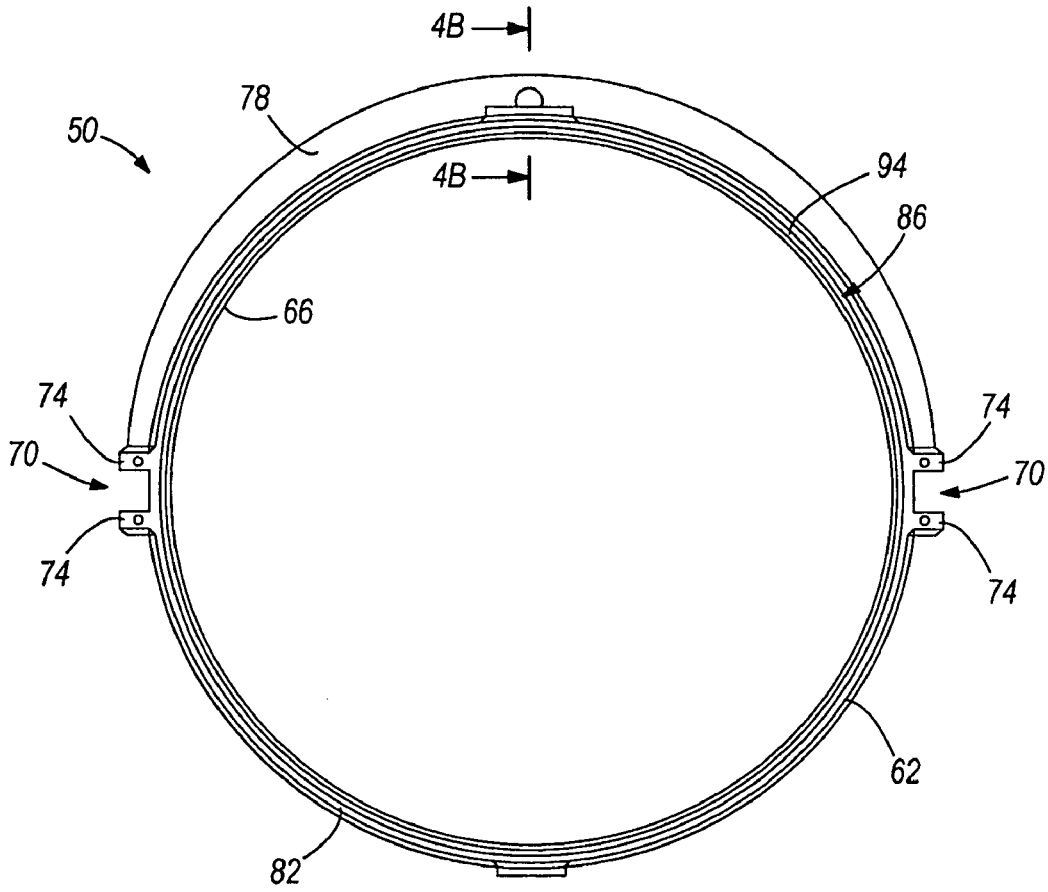
FIG. 4A is an end view of a coupling guard that is part of the coupling guard system shown in FIG. 2.
Figure 5:
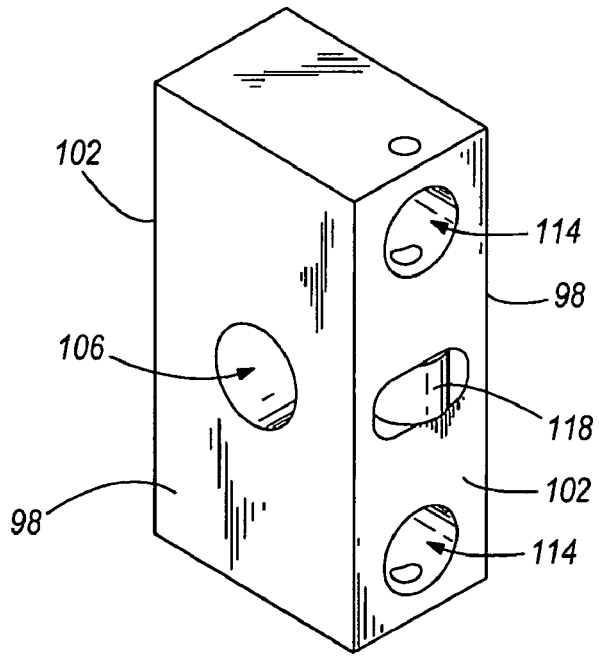
FIG. 5 is a perspective view of a slide adjuster that is part of the coupling guard system shown in FIG. 2.
Figure 4B:
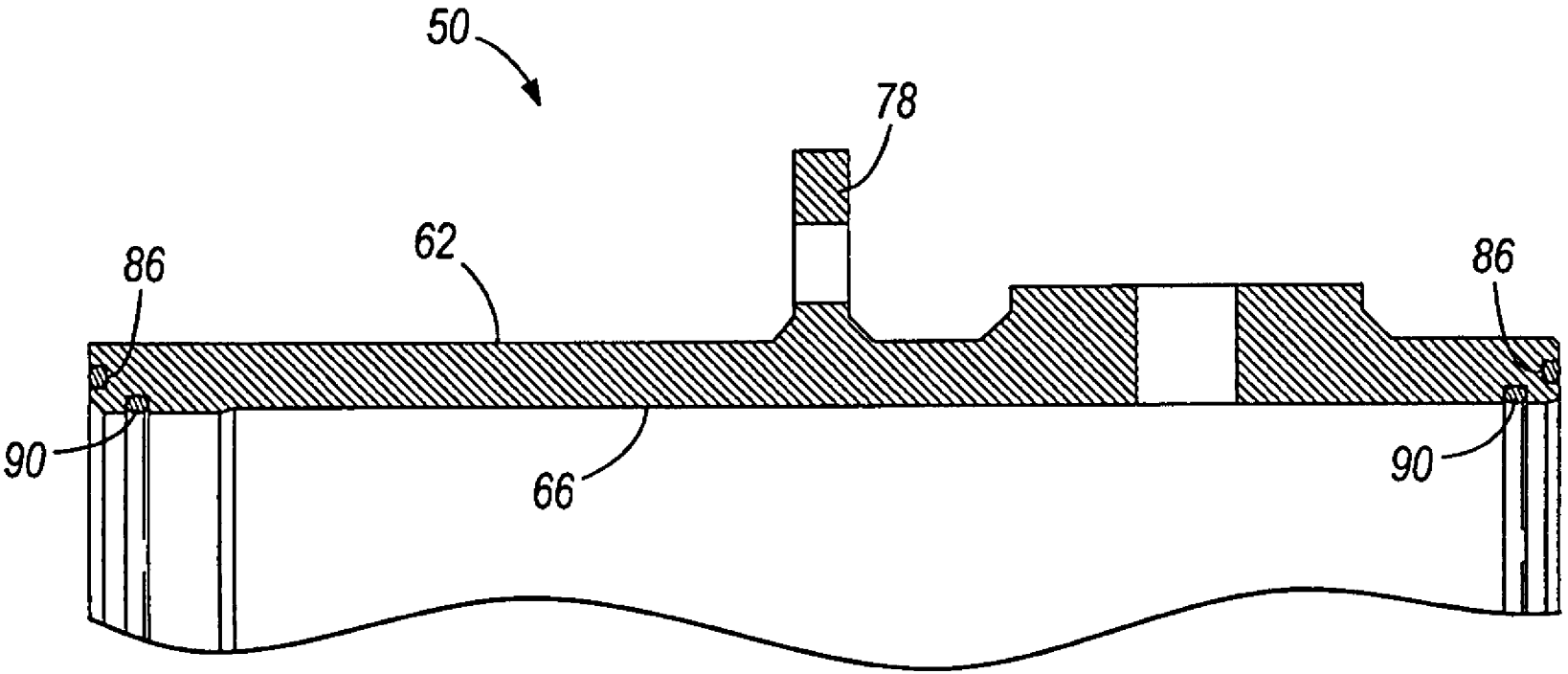
FIG. 4B is a sectional view of the coupling guard taken along line 4B-4B of FIG. 4A.
Figure 6:
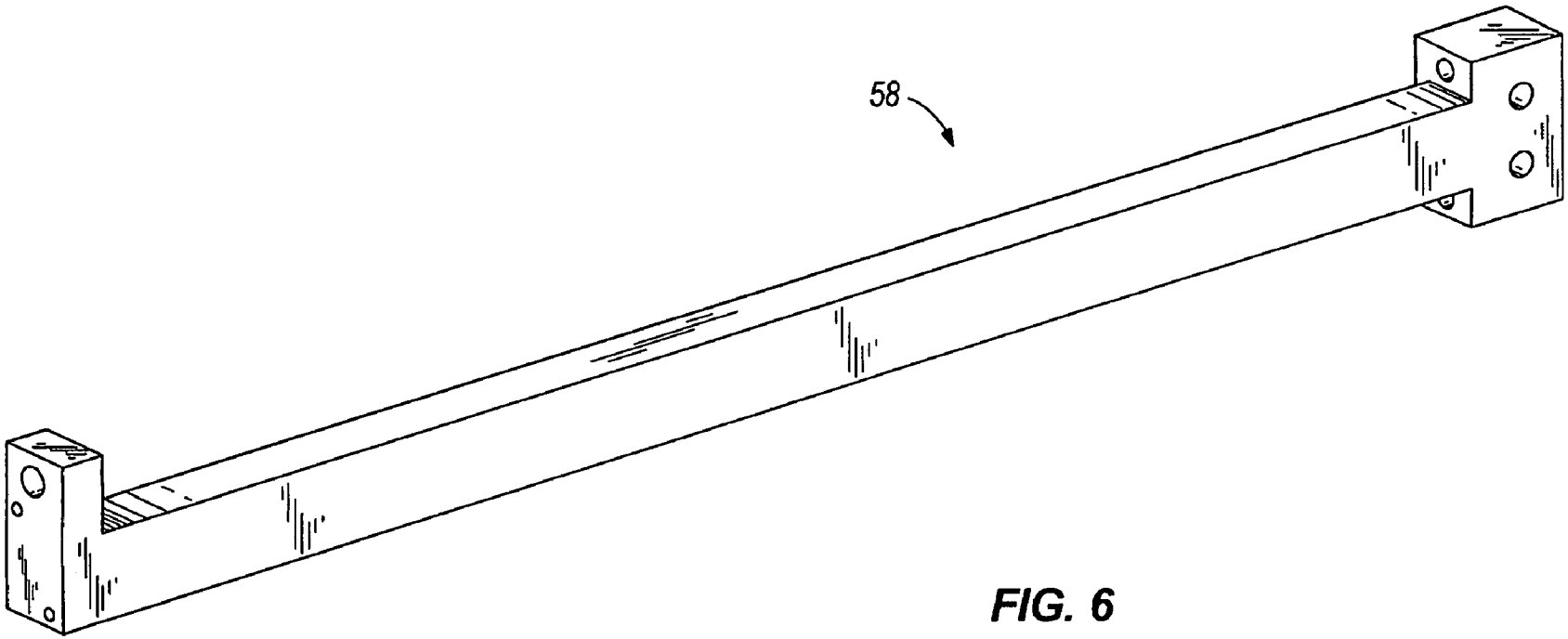
FIG. 6 is a perspective view of a slide guide that is part of the coupling guard system shown in FIG. 2.

The coupling guard system 46 includes the coupling guard 50 (FIGS. 4A and 4B), two pairs of slide blocks 54 (FIG. 5), or adjusters, and two slide guides 58 (FIG. 6), or bars. The coupling guard 50 is generally cylindrical and includes an exterior surface 62 and an interior surface 66. In the illustrated embodiment, the coupling guard 50 is constructed as a single ring having no bolted joints. The guard 50 includes two slots 70 defined on the exterior surface 62 with the slots 70 spaced approximately 180° apart. For example, one slot 70 is provided at a nine o'clock position and the other slot 70 is at a three o'clock position to control alignment and axial movement of the guard 50. Each slot 70 is defined by a pair of radially extending projections 74, and receives a slide guide 58 for sliding movement thereon. A radially extending flange 78 extends between the first and second slots 70. Structural ribs, lifting lugs, vents, drains and injection connections in the coupling guard 50 may be varied as appropriate and necessary. Any connecting hardware, pattern of openings, construction of casing and direction that the coupling guard retracts may be varied as appropriate or necessary.

At each axial end 82 of the coupling guard 50, sealing members 86, 90 are positioned such that when the coupling guard system 46 is in the closed position, the sealing members 86, 90 operate to prevent pressurized gases from escaping from the interior region 38 of the coupling 30. The sealing members 86, 90 provide a high integrity seal when the coupling guard system 46 is in the closed position. Various locations for the sealing members 86, 90 may be used as long as seal integrity is maintained. In the illustrated embodiment, the coupling guard 50 includes the sealing members 86, 90 or elements to facilitate sealing between the coupling guard system 46, the coupling 30 and the casings 22, 26. Sealing member 86 is positioned on a radial surface at each axial end 82 of the coupling guard 50. Sealing members 90 are positioned on the interior surface 66 of the coupling guard 50 at each axial end 82. In one embodiment, the sealing members 86, 90 each include a groove formed in the surface of the coupling guard 50 and an O-ring 94 received and retained in the groove. The diameter on which each groove is placed is minimally different so as to minimize axial forces exerted on the coupling guard 50 from the pressurized contents. In one embodiment, the sealing members 86, 90 have similar construction in order to minimize axial forces.

As shown in FIGS. 2 and 3, one pair of slide blocks 54 is attached to the projections 74 defining each slot 70. Each slide block 54 (FIG. 5) includes first and second end surfaces 98 and first and second side surfaces 102. An aperture 106 extends through the first and second end surfaces 98 for slidingly receiving a slide bar 110 extending from the motor casing 26 towards the compressor casing 22. The slide bar 110 provides directional guidance to the coupling guard system 46. At least one side surface 102 of the slide block 54 includes a pair of apertures 114 for coupling the block 54 to the coupling guard 50. In the illustrated embodiment, a roller 118 is positioned between the coupling apertures 114 for facilitating sliding movement of the coupling guard 50 along the slide guides 58. The roller 118 is directed toward the slot 70 such the respective slide guide 58 is sandwiched between the coupling guard slot 70 and the slide block 54. The slide blocks 54 are used as a manual slide adjuster to axially move the coupling guard 50 relative to the casings 22, 26. It should be readily apparent to those of skill in the art that other types of friction reducing components, such as low-friction inserts, may be used in the slide blocks 54.

The coupling guard system 46 includes the two slide guides 58 for providing directional guidance and support to the coupling guard 50 in axial movement between the closed position and the open position. Each slide guide 58 extends between the compressor casing 22 and the motor casing 26, as is coupled thereto. In one embodiment, the slide guides 58 may operate as an assembly tool. In still another embodiment, rollers may be provided in the slide guides 58 for facilitating sliding movement of the coupling guard 50. Referring to FIG. 2, a lock block 122 is positioned between the coupling guard 50 and a motor casing end of the slide guide 58 to prevent axial movement of the coupling guard 50 when in the closed position. It should be readily apparent to those of skill in the art that other known locking mechanisms may be used. Further, fewer or more slide guides 58 may be used. Also, other means for positioning and directing movement of the coupling guard 50, such as a linear tab engaging a slot or other type of similar positioning member, may be used.

In FIGS. 2 and 3, only one side of the coupling guard system 46 is shown; therefore, only one pair of slide blocks 54 and one slide guide 58 is shown. The second pair of slide blocks 54 and second slide guide 58 is located on the opposite side of the coupling guard system 46. That is, the slide blocks 54 and slide guides 58 are positioned approximately 180° degrees apart on each side of the coupling guard 50.

Referring to FIG. 2, the retractable pressure containing coupling guard system 46 is shown in a closed position. In the closed position, the sealing members 86, 90 engage mating surfaces on the compressor casing 22 and motor casing 26 to form a sealed enclosure around the coupling 30. A lock block 122 is positioned between the coupling guard 50 and a motor casing end of the slide guide 58 to prevent axial movement of the coupling guard 50. The lock block 122 provides a positive axial stop, while allowing the coupling guard 50 to float on the sealing surfaces 86, 90 as necessary during equipment operation. The lock block 122 is removed or moved to a non-blocking position in order to move the coupling guard system 46 to the open position.

To move the coupling guard system 46 to the open position, a user utilizes the slide blocks 54, or manual slide adjusters, to physically slide the coupling guard 50 along the slide guides 58. Rollers 118 on the slide blocks 54 facilitate sliding movement of the coupling guard 50. In a further embodiment, electric, hydraulic or pneumatic mechanisms may also be employed as a means to slide the coupling guard 50 between the closed position and the open position.

The coupling guard system 46 enables opening and closing of the coupling guard 50 with a simple, convenient process, and provides for ease of maintenance and sealing integrity.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

Since other modifications, changes and substitutions are intended in the foregoing disclosure, it is appropriate that the appended claims be construed broadly and in a manner consistent with the scope of the invention.

What is claimed is:

1. A guard system, comprising:

a coupling guard moveable between an open position, wherein the coupling guard allows access to an internal region of a coupling connected to a first component and a second component, and a closed position, wherein the coupling guard forms a seal surrounding the coupling from the first component to the second component, the coupling guard comprising:

a first axial end located proximal to the first component;

a second axial end located proximal to the second component;

a first radial sealing surface positioned at the first axial end; and a second radial sealing surface positioned at the second axial end; and a guide coupled to the coupling guard and extending between the first and second components, for directing movement of the coupling guard.

2. The guard system of claim 1, further comprising an adjuster coupled to the coupling guard for adjusting a position of the coupling guard.

3. The guard system of claim 2, wherein the adjuster comprises a roller engaging the guide.

4. The guard system of claim 1, wherein the coupling guard includes an outer circumference, and a first slot formed in the outer circumference and slidably receiving the guide.

5. The guard system of claim 4, wherein the coupling guard further comprises a second slot formed in the outer circumference and positioned 180° around the outer circumference apart from the first slot.

6. The guard system of claim 1, further comprising a lock block for maintaining the coupling guard in the closed position.

7. The guard system of claim 6, wherein the lock block is positioned between the coupling guard and the guide.

8. A guard system for a coupling that connects a motor casing and a compressor casing, comprising:

a coupling guard moveable between an open position, which allows access to an internal region of the coupling, and a closed position, in which the coupling guard forms a seal surrounding the coupling, the coupling guard comprising:

an axial end proximal to the compressor casing; and a radial sealing surface positioned at the axial end, for sealing the coupling guard to the compressor casing when the coupling guard is in the closed position;

a guide extending between the motor casing and the compressor casing; and an adjuster coupled to the coupling guard and slidably engaging the guide, for adjusting a position of the coupling guard relative to the guide.

9. The guard system of claim 8, wherein the coupling guard includes an outer circumference and a pair of slots defined therein, wherein each one of the pair of slots slidably receives the guide.

10. The guard system of claim 8, wherein the adjuster slidably receives the guide through an aperture defined in the adjuster, and includes a roller engaging the guide.

11. The guard system of claim 8, wherein:

the adjuster comprises:

a first slide block including first and second apertures defined therein; and a second slide block including third and fourth apertures defined therein; and the guide comprises:

a first slide bar extending through the first and third apertures; and a second slide bar extending through the second and fourth apertures.

12. The guard system of claim 11, wherein the adjuster further comprises a plurality of rollers, wherein at least one of the plurality of rollers is disposed in each of the first, second, third, and fourth apertures.

13. The guard system of claim 8, further comprising a circumferential sealing surface positioned proximal to the axial end of the coupling guard and radially between the coupling and the coupling guard.

14. A coupling guard system, comprising:

a coupling guard comprising:

a first axial end located proximal to a compressor casing;

a second axial end located proximal to a motor casing;

a radial sealing surface located at the first axial end; and a circumferential sealing surface located proximal to the first axial end, wherein the coupling guard is axially moveable between an open position, which allows access to an internal region between the compressor casing and the motor casing, and a closed position, in which the coupling guard forms a seal surrounding the internal region; and a guide comprising a slide bar extending between the compressor casing and the motor casing, and an adjuster coupled to the slide bar and the coupling guard, for adjusting positioning of the coupling guard on the slide bar.

15. The coupling guard system of claim 14, wherein the guide further comprises a lock block for maintaining the coupling guard in the closed position.

16. The coupling guard system of claim 15, wherein the lock block is positioned between the guide and the compressor casing.

17. The coupling guard system of claim 14, wherein the adjuster further comprises:

an aperture defined therein, through which the slide bar is received; and a roller engaging the slide bar.

18. The coupling guard system of claim 14, wherein the coupling guard includes an outer circumference and a slot defined therein that slidably receives the slide bar, for movement of the coupling guard on the slide bar.

* * * * *